US007149453B2

(12) United States Patent
Fujita

(10) Patent No.: US 7,149,453 B2
(45) Date of Patent: Dec. 12, 2006

(54) COOLING DEVICE FOR AN IMAGE FORMING APPARATUS

(75) Inventor: Atsushi Fujita, Hamura (JP)

(73) Assignee: Konica Minolta Holding, Inc., Tokyo (JP)

( * ) Notice: Subject to any disclaimer, the term of this patent is extended or adjusted under 35 U.S.C. 154(b) by 218 days.

(21) Appl. No.: 10/787,199

(22) Filed: Feb. 27, 2004

(65) Prior Publication Data

US 2004/0175202 A1 Sep. 9, 2004

(30) Foreign Application Priority Data

Mar. 3, 2003 (JP) ..... 2003-055462

(51) Int. Cl.
*G03G 21/20* (2006.01)

(52) U.S. Cl. ..... 399/92

(58) Field of Classification Search ..... None
See application file for complete search history.

(56) References Cited

U.S. PATENT DOCUMENTS 5,038,170 A * 8/1991 Serita ..... 399/92
5,297,004 A * 3/1994 Mazura ..... 361/690
5,325,158 A * 6/1994 Guelfo et al. ..... 399/92
5,544,012 A * 8/1996 Koike ..... 361/695
5,634,176 A * 5/1997 Ayash et al. ..... 399/92
5,689,766 A * 11/1997 Hollar et al. ..... 399/92
6,272,012 B1 * 8/2001 Medin et al. ..... 361/690
6,356,722 B1 * 3/2002 Kida ..... 399/92
6,554,697 B1 * 4/2003 Koplin ..... 454/184

FOREIGN PATENT DOCUMENTS

JP 2000177167 A * 6/2000
JP 2000194250 A * 7/2000
JP 2000277954 A * 10/2000
JP 2002149042 A * 5/2002

* cited by examiner

*Primary Examiner*—Robert Beatty
(74) *Attorney, Agent, or Firm*—Finnegan, Henderson, Farabow, Garrett & Dunner, L.L.P.

(57) ABSTRACT

An image forming apparatus wherein a flow path for cooling air is formed in a gap between a pair of plates which form a frame of the apparatus, and a unit constituting the apparatus to be cooled by cooling air that flows through the flow path.

2 Claims, 4 Drawing Sheets

COOLING DEVICE FOR AN IMAGE FORMING APPARATUS

BACKGROUND OF THE INVENTION

The present invention relates to an image forming apparatus such as a printer, a copying machine or a facsimile machine, and in particular, to a cooling technology in the apparatus.

In an image forming apparatus employing an imagewise exposure device whose light source is a laser, there is provided a cooling device on the exposure device because heat generated on a polygon motor or the like makes a temperature of the exposure device to rise.

In the image forming apparatus, heat generating sources such as a fixing unit and others are provided in addition to the polygon motor, and a cooling device is provided for controlling a temperature rise that is caused by heat generated by the aforesaid items.

In Japanese TOKKAI No. 2000-261174, for example, a flow path for cooling air is formed between a fixing unit and a laser-writing unit that is arranged above the fixing unit, so that a rise in temperature of the laser-writing unit caused by heat coming from the fixing unit may be prevented, and a rise in temperature caused by heat generated on the laser-writing unit may be prevented.

In Japanese TOKKAIHEI No. 11-212674, there is described a cooling method of an information processing apparatus of a rack-cabinet-housed type wherein a rack-cabinet is composed of a plurality of stays, and a part of the stays are used as a means to introduce cooling air and the others are used as a means to exhaust air.

In the cooling technology disclosed by Japanese TOKKAI No. 2000-261174, the cooling means scarcely contribute to reinforcement of a main body frame of an image forming apparatus. For this reason, the main body frame has been designed, in terms of materials and thickness, to be capable of satisfying necessary conditions for the strength of the apparatus, resulting in problems of high cost and an increase of mass. Thus, there has been a problem that a considerable increase in cost cannot be avoided, because an increase in cost for providing a cooling device is added to the aforementioned high cost.

In Japanese TOKKAIHEI No. 11-212674, there is provided an organization to cool the whole of an apparatus such as a server apparatus, and there is a problem that it is difficult to obtain a cooling function necessary to cool a specific portion in the apparatus, in the same way as in the image forming apparatus.

Further, in the case of the image forming apparatus, there is introduced a business style in which the same manufacturer places plural types of apparatus on the market simultaneously. In this business style, parts are made to be uniform among the plural types of equipment, to achieve rationalization such as cost reduction.

In the image forming apparatus, there are housed many units such as an exposure device, a developing unit and a cleaning unit which require cooling, and the number, types and installation positions for these units vary depending on the types of equipment, and therefore, the cooling means are different each other depending on the types of equipment, which results in a problem that uniformalization of parts is not advanced.

SUMMARY OF THE INVENTION

An object of the invention is to solve the aforementioned problems in prior arts and to provide an image forming apparatus which is low in cost and has necessary strength, and further to realize an image forming apparatus wherein parts related to cooling are made to be uniform among plural types of apparatus.

The objects of the invention stated above are attained by either one of the following Structures 1–6.

In accordance with one aspect of the invention, structure 1 provides an image forming apparatus wherein a flow path for cooling air is formed in a gap between a pair of plates which form a frame of the apparatus, and an imagewise exposure device is cooled by cooling air that flow through the flow path.

In accordance with another aspect of the invention, structure 2 provides a heat radiating fin provided on a frame for a polygon that houses a polygon motor of the exposure device is configured to be exposed to the flow path.

In accordance with another aspect of the invention, structure 3 provides an image forming apparatus wherein a plurality of holes are formed on a plate, a part of the plural holes are selected by a hole selecting means and a flow path for cooling air is formed by the selected hole.

In accordance with still another aspect of the invention, structure 4 provides a plate on which the plural holes are formed constituting a part of the framework of the apparatus.

In accordance with yet another aspect of the invention, structure 5 provides a plate on which the plural holes are formed is provided on each of the air introducing side and the air exhausting side of the cooling device, and the holes are selected by the hole selecting means to form a flow path for cooling air.

In accordance with still vet another aspect of the invention, structure 6 provides a manufacturing method for an image forming apparatus to manufacture plural types of image forming apparatuses wherein one or more sheets of plates are incorporated in common on the plural types of image forming apparatuses, a plurality of holes are provided on the plate, and a part of the plural holes are selected for each type of apparatus to form a flow path for cooling air.

DETAILED DESCRIPTION OF THE PREFERRED EMBODIMENT

Figure 1:
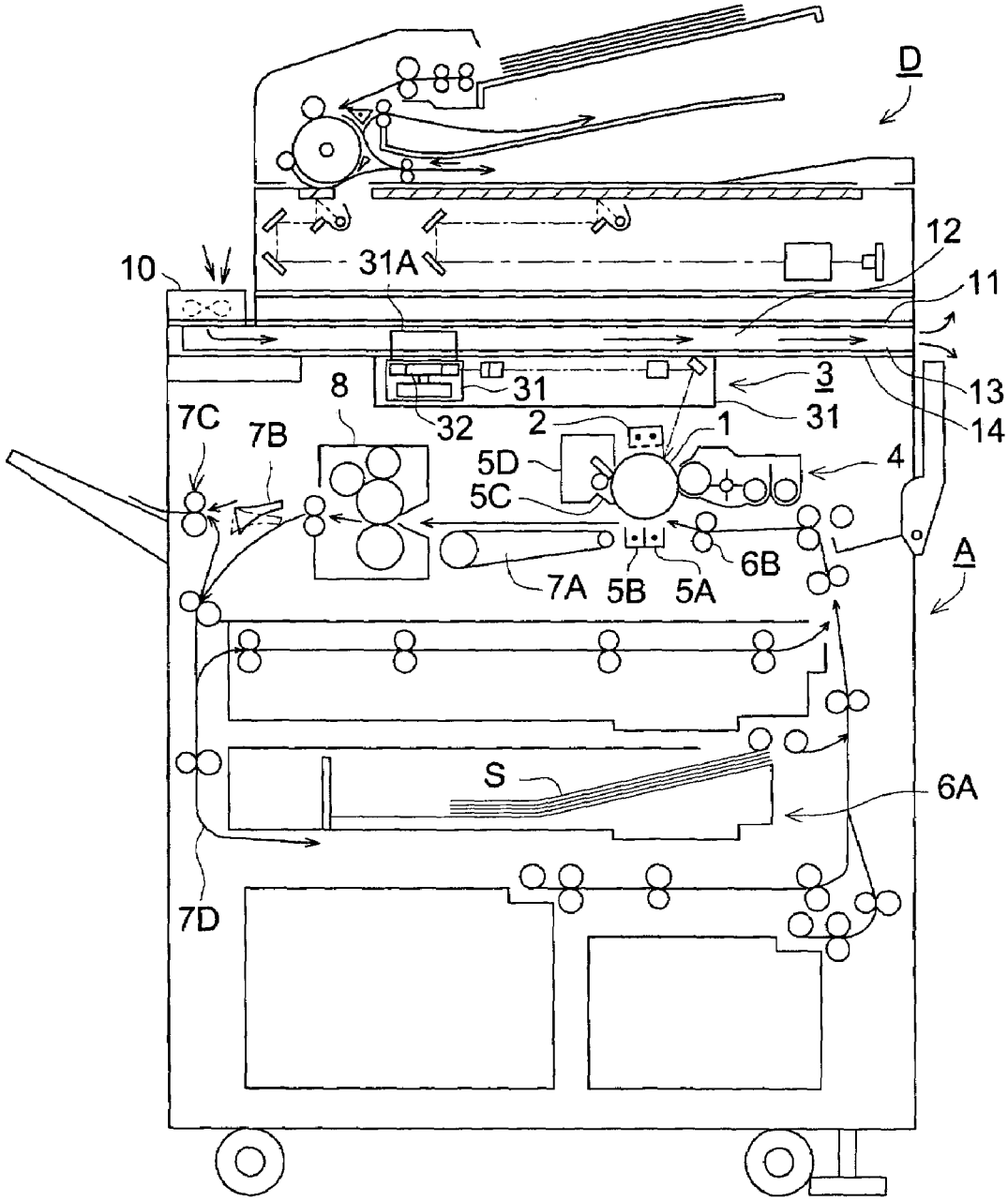
FIG. 1 is a diagram showing an image forming system relating to an embodiment of the invention.

FIG. 1 shows an image forming system relating to an embodiment of the invention, and the image forming system is composed of image forming apparatus A and image reading apparatus D provided on the image forming apparatus A. Incidentally, it is also possible to employ the organization wherein the image reading apparatus D is formed as a part of the image forming apparatus A, and an image reading portion is supported by the framework of the image forming apparatus A.

The image forming apparatus A has therein charging unit 2, imagewise exposure device 3, developing unit 4, transfer unit 5A, neutralizing unit 5B, separating claw 5C and cleaning unit 5D which are provided around rotating photoreceptor 1, and after uniform charging is conducted by charging unit 2 on a surface of photoreceptor 1, exposure scanning based on image data obtained from a document through reading by a laser beam of exposure device 3 is carried out to form a latent image, thus, the latent image is subjected to reversal development conducted by the developing unit 4, and a toner image is formed on a surface of photoreceptor 1.

Recording material S fed from sheet feeding unit 6A is conveyed to a transfer position through intermediate sheet feeding section 6B. In the transfer position, the toner image is transferred by the transfer unit 5A onto the recording material S. After that, charges on the reverse side of the recording material S are erased by the neutralizing unit 5B, the recording material S is separated from photoreceptor 1 by the separating claw 5C, then is conveyed by sheet conveyance unit 7A and is heated and fixed by fixing unit 8 to be ejected out by sheet ejection roller 7C. Incidentally, when image forming is carried out on a single surface of recording material S, conveyance path switching plate 7B is in a position shown with broken lines.

The surface of the photoreceptor 1 after transferring of the toner image is cleaned by cleaning unit 5D at the downstream side of the separating claw 5C so that residual developer staying on the surface of the photoreceptor may be removed, to be ready for succeeding image forming.

On the other hand, in the case of forming images on both sides of recording material S, when the conveyance path switching plate 7B is switched to the state shown by solid lines, the recording material S heated and fixed by fixing unit 8 is conveyed downward to switchback in reversal conveyance unit 7D to be reversed from side to side, and another toner image is transferred onto the reversed side of the recording material S at the transfer position. After that, the recording material is heated and fixed in the same process as in the foregoing, and is ejected out by sheet ejection roller 7C, after passing through the conveyance path switching plate 7B switched to the state shown with broken lines.

Figure 2:
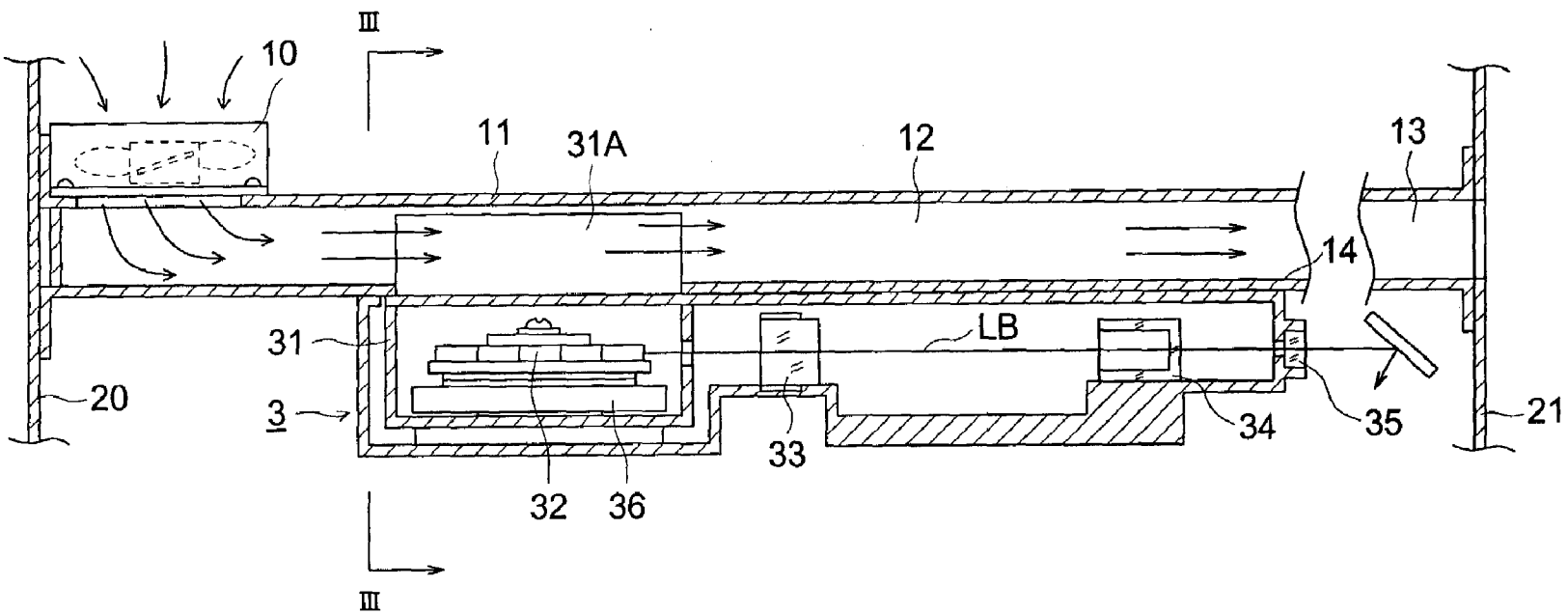
FIG. 2 is a diagram showing an exposure device and a cooling device in the image forming apparatus shown in FIG. 1.
Figure 3:
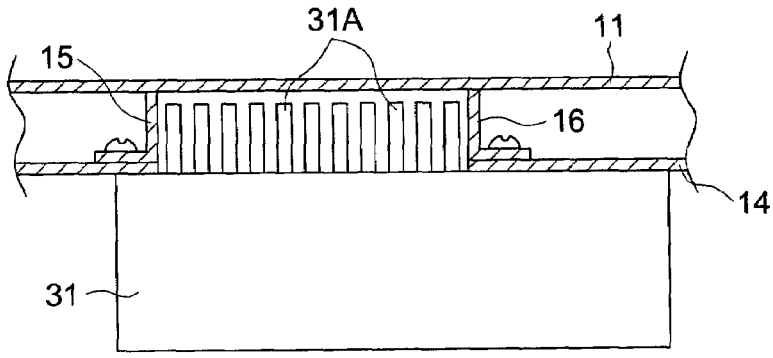
FIG. 3 is a sectional view taken on line III—III in FIG. 2.

Next, an example of a cooling means of an exposure device in the embodiment of the invention will be explained as follows, referring to FIGS. 2 and 3. FIG. 2 is a sectional view of the exposure device and the cooling means of the image forming apparatus shown in FIG. 1, while, FIG. 3 is a sectional view taken on line III—III in FIG. 2.

Polygon housing 31 that houses therein polygon mirror 32 and a polygon motor 36 is provided in exposure device 3 provided in image forming apparatus A, and numbers of heat radiating fins 31A (see FIG. 3) are provided above the polygon housing 31. The exposure device 3 has therein polygon mirror 32, fθ lens 33, cylindrical lens 34 and light-transmitting plate 35 that forms an exit window, and light beam LB emitted from an unillustrated semiconductor laser is reflected by polygon mirror 32 and is transmitted through fθ lens 33, cylindrical lens 34 and light-transmitting plate 35 to enter photoreceptor 1 (FIG. 1).

A frame that forms a framework of image forming apparatus A is constructed doubly and is composed of sheet-shaped upper frame 11 and lower frame 14.

A framework of an image forming apparatus is made up generally of side plates located at front and rear and at right and left as well as of stays connecting these side plates, and necessary openings are formed on each side plate. Upper frame 11 and lower frame 14 constitute the framework of this kind, and both ends of the framework are connected firmly to left side plate 20 and right side plate 21 respectively through a connecting means such as welding or screwing.

Exposure device 3 is fixed on the lower frame 14. The exposure device 3 is housed in polygon housing 31, and polygon housing 31 that houses polygon mirror 32 is made of thermal-conductive material such as aluminum, and has, on its upper portion, numbers of heat radiating fins 31A. The upper frame 11 and the lower frame 14 constitute a duct that forms air flow path 12 together with side plates 15 and 16 in FIG. 3. The heat radiating fins 31A are exposed to the flow path 12.

Air introduced by fan 10 into the flow path 12 travels as shown with an arrow to cool the heat radiating fins 31A, and is ejected from exhaust portion 13 on the right end of the apparatus as shown in FIG. 1.

Figure 4:
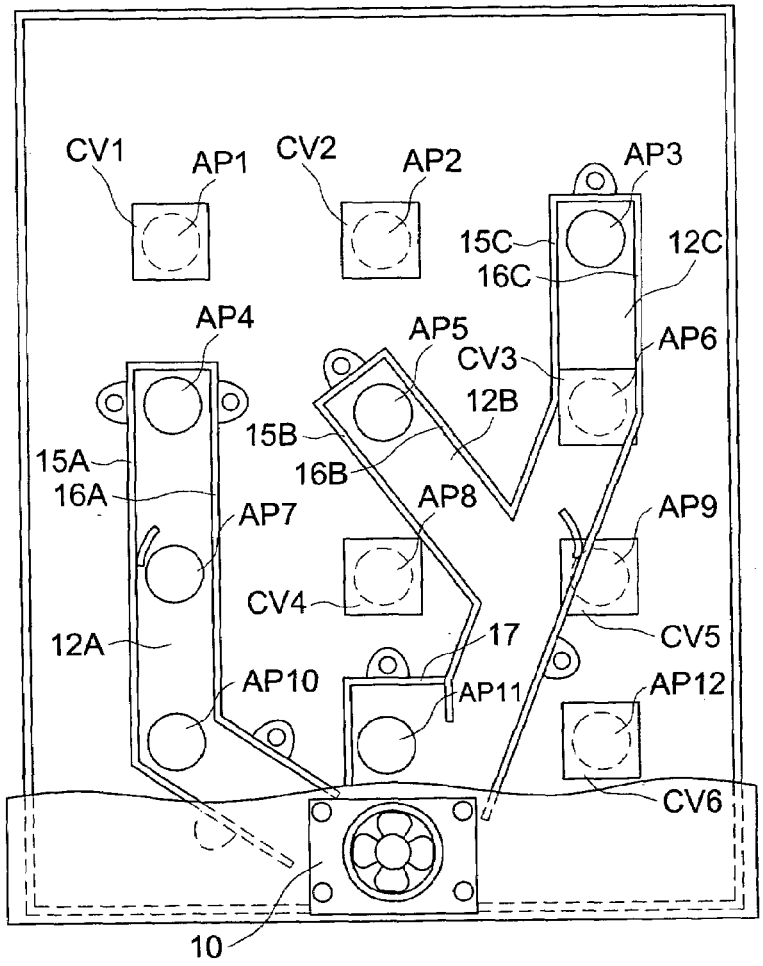
FIG. 4 is a top view of a duct forming a flow path for cooling air in another example of an image forming apparatus relating to the embodiment of the invention.
Figure 5:
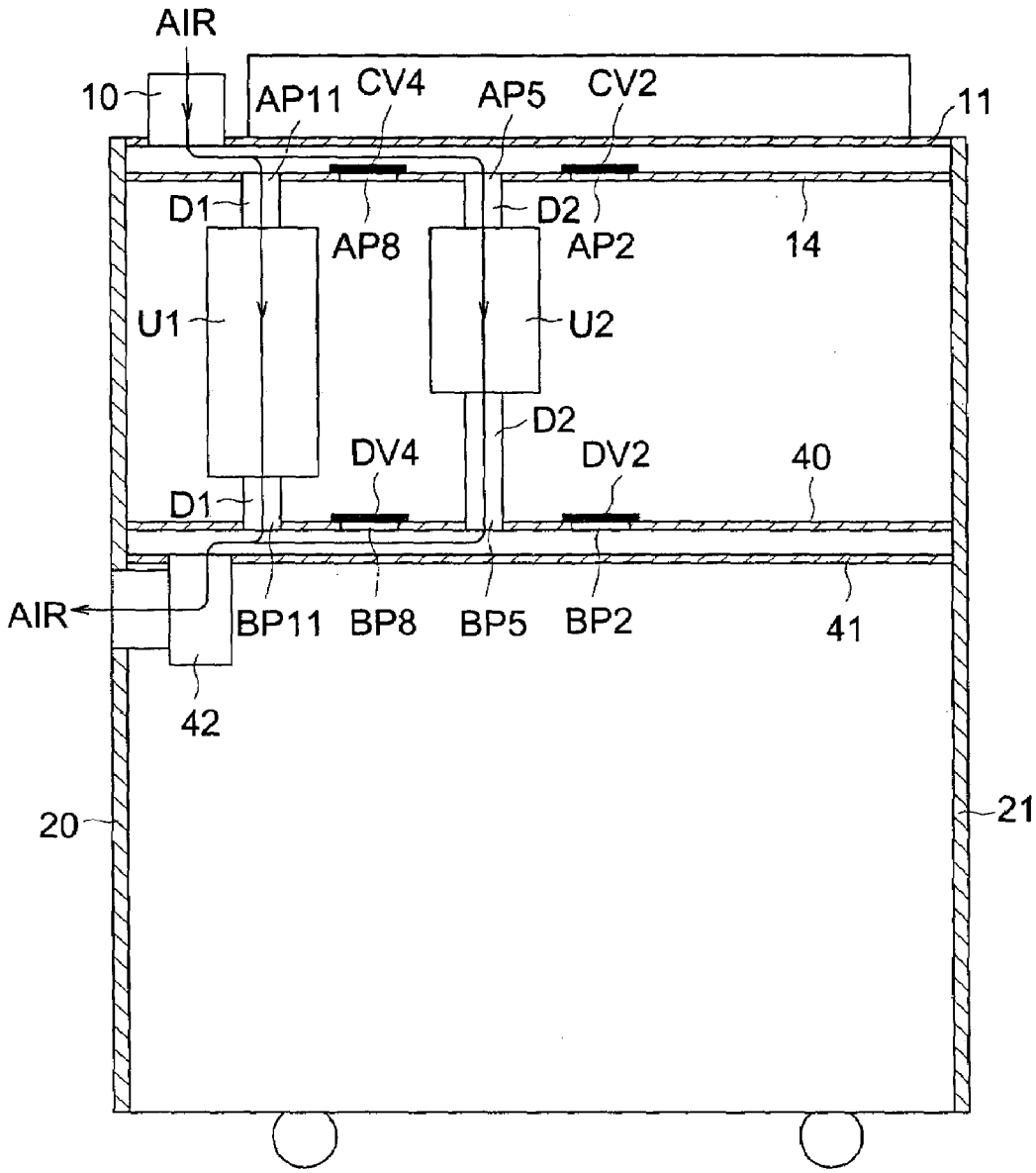
FIG. 5 is a central sectional view of an image forming apparatus having therein a duct shown in FIG. 4.

FIG. 4 is a top view of a duct that forms a flow path for cooling air in another example of an image forming apparatus relating to the present embodiment of the invention, and FIG. 5 is a central sectional view of an image forming apparatus equipped with a duct shown in FIG. 4.

Upper frame 11 and lower frame 14 each being made of sheet metal in FIG. 5 are arranged to face each other on the upper portion of the apparatus.

Between the upper frame 11 and the lower frame 14, there are fixed partition plates 15A–15C, 16A–16C and 17 which form a duct, and each pair of partition plates facing each other such as 15A and 16A, for example, form each of air flow paths 12A–12C.

On the lower frame 14, there are provided holes AP1–AP12. A part of the holes AP1–AP12 are closed by cover members CV1–CV6 each serving as a hole selecting means. Each of holes AP3, AP4, AP5, AP7, AP10 and AP11 that are not covered by the cover members CV1–CV6 serves as an air vent.

To the lower portion of the hole AP11, there are connected duct D1 and unit U1, and to the lower portion of the hole AP5, there are connected duct D2 and unit U2. Incidentally, in the same way as in the foregoing, a duct and a unit are connected to the lower portion of each of the holes AP3, AP4, AP7 and AP10, although these are not shown in FIG. 5.

Cooling air AIR introduced into the apparatus by fan 10 passes through flow paths 12A, 12B and 12C to be introduced into respective units including units U1 and U2, and is exhausted after cooling the aforementioned units.

In the central portion of the apparatus, upper frame 40 and lower frame 41 each being made of sheet material are provided to be fixed respectively on side plate 20 and side plate 21. The upper frame 40 and the lower frame 41 also form a flow path for air in the gap between these frames, in the same way as in the upper frame 11 and the lower frame 14, and a duct is formed by partition plates which are similar to those shown in FIG. 4, although this is not illustrated. Further, on the upper frame 40, there are formed holes BP1–BP12 corresponding respectively to holes AP1–AP12, and a part of these holes BP1–BP12 are closed by cover members DV1–DV6 corresponding respectively to the cover member CV1–CV6. In FIG. 5, holes BP2, BP5, BP8 and BP11 only are shown, and cover members DV2 and DV4 only are shown. The numeral 42 represents a fan for air exhaustion, and cooling air AIR introduced by fan 10 as shown by the arrow passes through holes AP11 and D1 to cool unit U1, and then, passes through duct D1 and hole BP11 to be exhausted by fan 42, thus, it is ejected by fan 42 after passing through duct D2 and hole BPS, after passing through hole AP5 and D2 to cool unit U2.

As a unit and a device to be cooled, there are given an exposure device, a developing unit, a sheet conveyance device such as a sheet re-feeding device for two-sided image forming, a cleaning unit, a fixing unit, an uncurler, and a toner replenishing unit, and in the color image forming apparatus, an exposure device, a developing unit and a cleaning unit are provided for each of image forming sections for yellow, magenta, cyan and black, and each apparatus is cooled by the cooling means described above, as occasion demands.

Depending on an apparatus model, the image forming apparatus is different from others in terms of a type, a quantity and a position of arrangement of a cooling device.

The invention makes it possible to uniformalize parts for different machine models and to provide a cooling means for units each being different in terms of position and number, by manufacturing main body frameworks in common for each machine model and by selecting and using cover members CV1–CVn.

It is also possible to use side plates 15 and 16 as a hole selecting means, and thereby to change positions of installation of side plates 15 and 16 for each machine model so that it corresponds to a difference of positions for cooling units.

In structure 1 or 2 or structure 4, it is possible to provide an image forming apparatus capable of cooling each section effectively while keeping necessary strength, because a framework in the image forming apparatus is used as a duct that forms a flow path for cooling air that cools each section.

In Structure 2, a polygon motor can be cooled satisfactorily.

In structures 3–6, a cost can be reduced because a part of the cooling means in plural types of apparatus that are different from each other in terms of types of cooling units, the numbers and installation positions thereof can be made common parts.

What is claimed is:

1. An image forming apparatus comprising:

(a) a pair of plates spaced apart from each other to provide a gap therebetween which constitute a frame of the apparatus and form a flow path for cooling air between the gap, wherein one of the plates has a plurality of holes and a part of the plurality of holes is selected by a selection member to form the flow path for the cooling air; and (b) a unit constituting the apparatus to be cooled by the cooling air flowing in the flow path, wherein the unit is at least one of an exposure device, a developing unit, a sheet conveyance device such as a sheet re-feeding device for two-sided image forming, a cleaning unit, a fixing unit, an uncurler, and a toner replenishing unit.

2. The image forming apparatus of claim 1, further comprising a unit constituting the apparatus to be cooled and two frames which have the pair of plates, respectively, wherein an air introducing side and an air exhausting side of the unit are arranged to face one of the plurality of holes in each plate of each frame, and the holes are selected, thereby forming the flow path of the cooling air.

* * * * *